US005092246A

United States Patent [19]

Huerta

[11] Patent Number: 5,092,246

[45] Date of Patent: Mar. 3, 1992

[54] SMALL ARMS AMMUNITION

[76] Inventor: Joseph Huerta, 399 Clover St., Aberdeen, Md. 21001

[21] Appl. No.: 368,776

[22] Filed: Apr. 12, 1982

[51] Int. Cl.[5] ..... F42B 10/00

[52] U.S. Cl. ..... 102/439; 102/501; 102/514

[58] Field of Search ..... 102/430, 439, 501, 503, 102/506-510, 517-519, 514, 515

[56] References Cited

U.S. PATENT DOCUMENTS

| | | | |
|---|---|---|---|
| 740,849 | 10/1903 | Groff | 102/519 |
| 1,292,388 | 1/1919 | Bowers | 102/503 |
| 4,301,736 | 11/1981 | Flatau et al. | 102/503 |

FOREIGN PATENT DOCUMENTS

| | | | |
|---|---|---|---|
| 29367 | 7/1907 | Austria | 102/503 |
| 11365 | 2/1910 | France | 102/501 |
| 826145 | 3/1938 | France | 102/503 |

*Primary Examiner*—Harold J. Tudor

*Attorney, Agent, or Firm*—Anthony T. Lane; Edward Goldberg; Michael C. Sachs

[57] ABSTRACT

An elongate projectile for small arms use has a single unitary mass with a hollow nose cavity defined by a sharp rigid cutting edge adapted to make initial contact with the target surface and cut therethrough. The projectile then enters the target mass in an unstable flight mode. The projectile base is substantially solid such that the nose cavity, while relatively deep, does not extend entirely through the base and the projectile center of gravity is aft of its geometric center.

3 Claims, 3 Drawing Sheets

SMALL ARMS AMMUNITION

GOVERNMENTAL INTEREST

The invention described herein may be manufactured, used, and licensed by or for the Government for governmental purposes without the payment to me of any royalties thereon.

FIELD OF THE INVENTION

This invention relates to improvements in small arms ammunition and more particularly to improved small arms ammunition having a conventional primed cartridge case and a hollow point projectile in tubular outer form.

BACKGROUND OF THE INVENTION

While the present invention is of general application to all forms of ammunition and small arms ammunition in particular, the same was developed in connection with a program to improve the accuracy and effectiveness of personal defense weapons, such as pistols, and, hence, the invention will be described in association with a discussion of this type weapon. However, as will be readily appreciated by those of ordinary skill in the art, the concepts for improvement of ammunition herein disclosed are fully applicable to all forms of small arms ammunition and will have special application where the weapon being considered is not highly accurate, otherwise exhibits characteristics which are viewed as detracting from its effectiveness, or to add to the terminal effectiveness of said weapons.

Automatic pistols are not generally viewed as accurate weapons when employed by the average shooter. The mass of moving parts associated with recoil, counter-recoil, ejection and feeding functions represents a substantial proportion of the total gun, whereby in use, shooters are distracted and apprehensive in aiming and firing the weapon. Also, the typically heavy slug results in lower missile velocity at the same total impulse than would a lighter bullet.

In an effort to improve weapon effectiveness and overcome some of the noted deficiencies of conventional solid projectiles, hollow tubular rounds have been recently developed for small arms use. This type of round has a passage completely through the round from the nose to the base thereof oriented about its center longitudinal axis. The objective of such rounds is to reduce total drag by allowing airflow to occur through the projectile rather than build up resistance at the nose. Ammunition of this type is more costly to manufacture than conventional bullets, mainly because hollow bullets cannot be accelerated through a gun barrel by force of propellant gas unless the hollow center of the bullet is blocked to prevent escape of pressure therethrough. Thus, in addition to the tubular projectile itself, separate and independent components must be used in conjunction with the round to transmit, and such propellants are commercially available. Pusher disc and an obturator or sabot, must separate from the hollow projectile as soon as it exits from the muzzle and without disrupting the bullet path, such as by application of sudden lateral or unsymmetrical forces during displacement and separation from the bullet. Among the principal disadvantages of this design are (a) extra components in addition to the projectile are required to fire the projectile from the gun barrel, (b) the size and weight of the projectile are limited because of these extra components, (c) these components occupy space in the cartridge case reducing the volume available for propellant, (d) these components reduce the reliability and accuracy in performance of the round because their separation from the projectile as they exit the gun barrel may cause minute perturbations which produce magnified disruptions in ballistic effects, particularly in lightweight projectiles common to small arms. Finally, since the pusher disc and sabot or obturator are both precision-formed parts, their manufacture and subsequent assembly by delicate operations into a complete round of ammunition add a huge cost increment to the normal mass production costs of conventional ammunition involving only a single unitary projectile.

Another drawback of tubular projectiles is their typically low ratio of transferred energy to total momentum at impact. Thus, a round which exits a target mass after penetrating the same obviously has retained much of its momentum even after impacting the target. This retained energy compromises the lethality of the round, since maximum effectiveness of any round is achieved only when 100 percent of the energy from a round is transferred into the target and nothing is retained in the round.

Some ammunition improvements of the type discussed have resulted in modest gains in accuracy, effectiveness against targets and penetration capability against modern protective materials, no single bullet design has yet combined all of these advantages in a single round, especially with regard to economical production costs.

Therefore, it is an object of this invention to provide improved small arms ammunition capable of being employed in conventional weapons.

A further object of this invention is to provide small arms ammunition exhibiting markedly improved accuracy and effectiveness against targets.

An additional object of this invention is to provide improved small arms ammunition capable of high muzzle velocity without increasing total impulse such as would increase wear and tear of weapons.

Another object of this invention is to provide improved small arms ammunition exhibiting higher energy deposit characteristics in soft targets.

A further object of this invention is to provide improved arms ammunition capable of penetrating currently available armor without a significant loss in target penetration.

An additional object of this invention is to provide improved small arms ammunition combining the performance advantages stated above, but capable of manufacture at a cost closely comparable to the cost of conventional ball type ammunition.

Other objects and advantages of the invention will become clear from the following description of an illustrative embodiment thereof.

SUMMARY OF THE INVENTION

This invention eliminates the need for pusher discs and obturators, while retaining the terminal effectiveness of tubular projectiles. A conventional primed cartridge case and a simple unitary, one-piece projectile in a modified tubular geometric form are provided wherein the projectile includes a main body portion and a nose of circular cross-section expanding back to the main body portion in the same manner generally as a hollow tubular round. However, as an intermediate reaction between the nose and tail of the projectile, an internal wall or partition is integrally formed within the projectile which totally interrupts the continuity of the airflow which would otherwise occur through the projectile if it were hollow.

BRIEF DESCRIPTION OF THE DRAWINGS

The invention will be more clearly understood by reference to the following detailed description of an exemplary embodiment thereof in conjunction with the accompanying drawings in which.

DETAILED DESCRIPTION OF THE PREFERRED EMBODIMENT

Figure 1A:
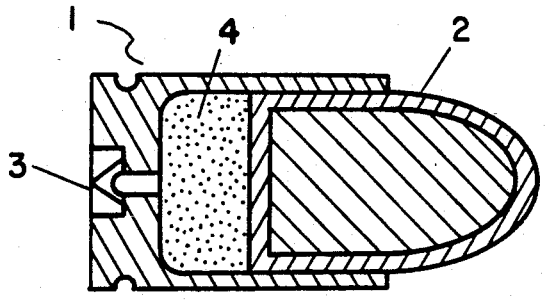
FIGS. 1A–1C illustrate a conventional caliber .45 ball projectile.
Figure 1B:
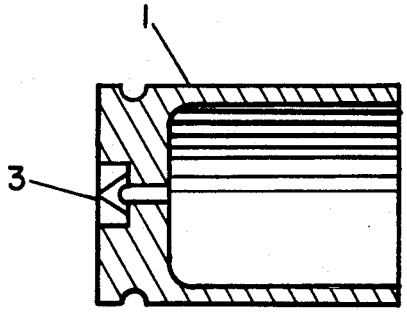
Figure 1C:
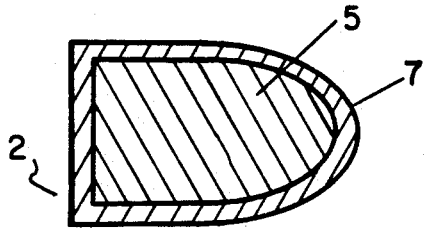
FIG. 1C PRIOR ART

Referring now to the drawings and more particularly to FIGS. 1A–1C thereof, there is shown a conventional caliber .45 ball round. The conventional caliber .45 ball round illustrated in FIG. 1A comprises a primed cartridge 1 having a solid projectile 2 disposed therein. The primed cartridge 1 is separately illustrated in FIG. 1B while the ball projectile is best shown in FIG. 1C The primed cartridge 1 has a primer 3 disposed in the rear portion thereof so that the round may be fired upon striking of the primer 3 by the weapon's firing pin and is provided with suitable propellant 4 disposed within the primed cartridge 1 intermediate the ball round 2 and the primer 3. The ball round 2 employed within the conventional caliber .45 round illustrated in FIG. 1A, weighs approximately 230 grains and has a lead alloyed core 5 about which is disposed gilded metal jacket 7 generally made of copper or the like.

Upon firing of the conventional caliber .45 round illustrated in FIG. 1A, the bullet is launched at approximately 860 ft per second from a primed casing utilizing approximately 5 grains of propellant. As used in the M1911A1 caliber .45 U. S. Army pistol, the round produces a substantial kick or recoil force and this weapon is not highly accurate when used by the average soldier. Furthermore, biophysics or wound ballistic testing and analysis has revealed that the conventional caliber .45 projectile does not deposit a great amount of its kinetic energy upon hitting an unprotected or normally clothed individual. Thus, while the ball round 2 produces a relatively large wound track, the projectile does not expend sufficient energy within the human target media and may exit the target retaining a reasonable amount of energy. In addition, recent testing has shown that conventional body armor will prevent the Army standard issue caliber .45 projectile from penetrating both body armor and the object protected even when the same impacts at muzzle velocity.

Figure 2:
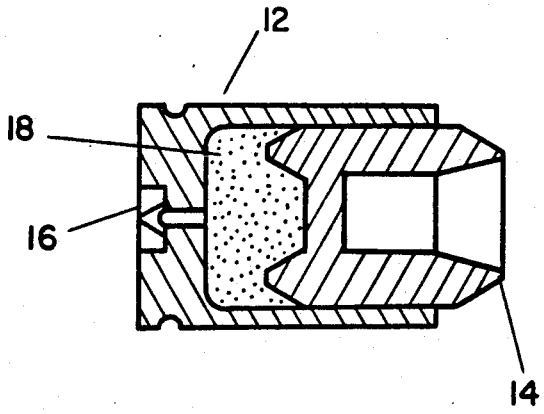
FIG. 2 is a sectional illustration of a preferred embodiment of the improved small arms ammunition according to the present invention.
Figure 3:
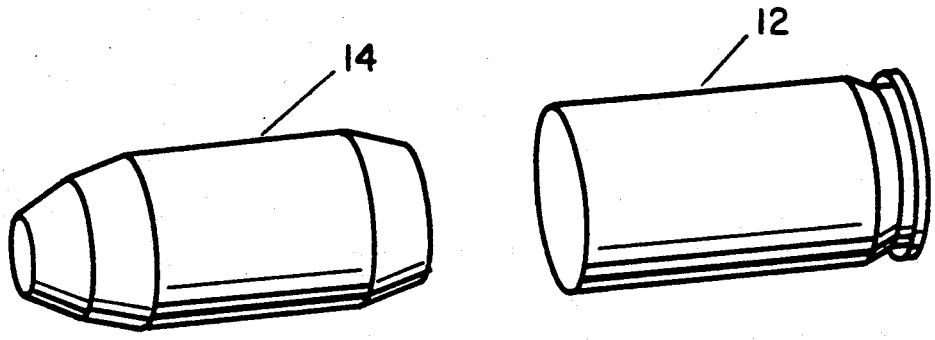
FIG. 3 is an exploded view in perspective showing two principal components of the structure in FIG. 2.

Referring now to FIG. 2, there is shown in perspective an exemplary embodiment of the improved small arms ammunition according to the present invention. It will be appreciated from the description set forth above that the exemplary embodiment of the invention set forth herein has application to all forms of small arms ammunition and some large caliber applications, even though the same is disclosed in association with a caliber .45 round. Particularly impressive results have been achieved, for example, with 9 mm ammunition using the inventive projectile configuration disclosed in this case. The improved small arms ammunition round 10 illustrated in FIG. 2 comprises a primed cartridge 12, and modified tubular projectile means 14, primer 16, and propellant 18. The primed cartridge 12 may take identically the same form as that employed in a conventional caliber .45 ball round as illustrated in FIG. 1B and, hence, is provided with primer 16 and propellant 18. The primer 16 may take the same form as that employed in a conventional round; however, the propellant 18 may be modified to be faster burning due to the lighter projectile employed, as will be described hereinafter. Typical of suitable commercially available propellants are propellants sold under the marks "Bulls Eye" and "Red Dot" as marketed by the Hercules Powder Company.

Figure 4:
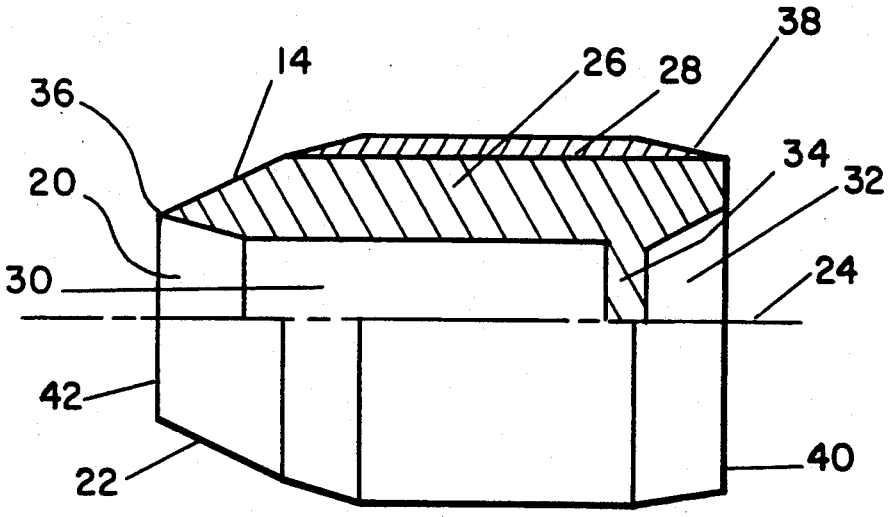
FIG. 4 is a side view, partly in cross-section, of a modification of the projectile in FIG. 2.

The modified tubular projectile means is best seen in FIG. 4 showing a sectional side elevation of the tubular projectile means 14. Projectile means 14 is of generally tubular geometry and in the case of a caliber .45 projectile will have a diameter which corresponds to the diameter of the projectile 2 illustrated in FIG. 1C which has a dimension of 0.450 inches. However, ammunition for other caliber weapons will have projectiles whose diameters correspond to the caliber or diameter appropriate to that weapon. The length of the projectile 14 is preferably such that the projectile length to diameter ratio is approximately 1.5 to 1; however, wide variation in this ratio is possible within the design constraints used for ballistic stability, effectiveness, and cartridge envelope.

The projectile means 14 is preferably fabricated of a hard or tough material, such as steel, high density materials, powder alloys, or various high strength composite materials. The projectile has a circular nose 20 which has been found to achieve a cutting action upon target impact that is not possible with relatively blunt nose shaping of conventional projectiles such as seen in FIG. 1A. In addition, the conventional "hollow-point" or "dum-dum" bullet has a relatively soft nose and upon impact with a target surface, the nose deforms or mushrooms. By contrast, biophysic testing has shown that the hard material of the projectile 14 with the sharp leading edge formed by the circular nose 20 does not exhibit this characteristic in that the projectile 14 does not mushroom or deform, but maintains its shape while penetrating body armor and/or simulated body tissue.

From the circular nose 20, the projectile 14 expands as indicated by the surface 22, at an angle designed to allow individual rounds to be fed from a magazine without causing a weapon malfunction and to achieve a significant reduction in drag coefficient compared with the conventional ogive nose shape seen in FIG. 1C, for example. The taper of the surface 22 may vary from 10 to 45 degrees relative to the center longitudinal axis 24 and more specifically within a preferred range of 15 to 35 degrees.

The tapered nose surface 22 expands into the main body portion 26 of the projectile 14. Since the projectile will usually be fabricated from hard material, such as steel or the like, a softer more ductile material, such as copper, is used to form a rotational outer layer 28 about a portion of the main body 26. The rotational layer 28 engages the rifling with a gun barrel to transmit torque or rotational movement to projectile 14 as it traverses through the gun barrel.

The projectile 14 may be seen to consist of a body of revolution, in the sense that its shape and contour are defined by rotating the cross-sectional portion above line 24 in a 360 degree are about the line which constitutes the center longitudinal axis through the projectile. Line 24 also defines the trajectory or path of travel of projectile 14 after it leaves a gun muzzle. In FIG. 4, such travel is toward the left, whereby tapered nose 22 will first impact the target (not shown), before any other portion or surface of the projectile.

The terminal ballistics of projectile 14 are of particular significance to the invention in this case, and are directly dependent upon the shape and the hardness of the projectile and especially of nose 20. Thus, the projectile is generally cylindrical in shape, with substantially concentric inner and outer wall surfaces which define forward cavity 30 and outer layer 28, respectively. The forward portion of the cylinder has two beveled or frusto-conical surfaces which converge to form a sharp leading edge 36 of circular or annular shape defining a plane 42.

Similarly, a shallow cavity 32 is formed in the aft or tail end of projectile 14. Cavities 30 and 32 are separated from each other by a wall or partition 34 which preferably is integrally formed with main body portion 26 in a single unitary mass as suggested particularly by FIG. 2. Where the material of projectile 14 is of sufficient softness to permit interengagement of its outermost surface with the rifling of a gun barrel without unduly eroding the barrel, no outer layer 28 need be added. As seen from FIG. 4, however, the aft end of projectile 14, either with or without a jacket layer 28, has a boattail shape 38 with an annular flat surface defining a plane 40 and is symmetrical about axis 24. Wall 34 is intermediate forward and aft planes 42 and 40, respectively, and is preferably closer proximate the aft end than the forward end. A preferred location range for the wall with respect to the total length of the projectile between planes 40 and 42 is from 1.0 to 3.5 diameters back from plane 42, referring to the outside diameter of-projectile 14 which corresponds closely to the caliber of the projectile.

Figure 5:
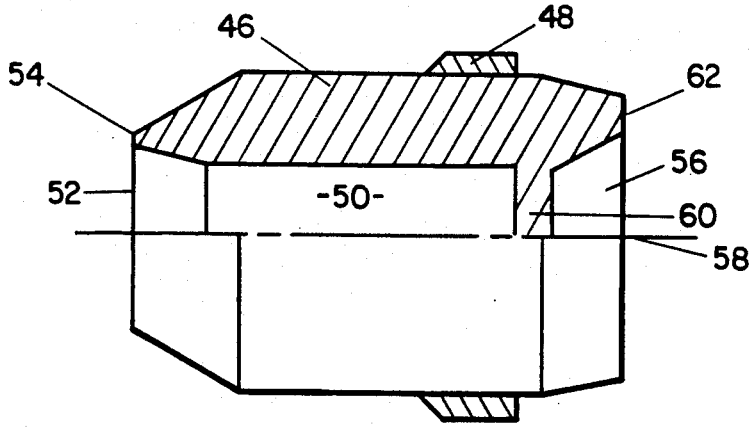
FIG. 5 is a view similar to FIG. 4 showing another modification of the FIG. 2 projectile.

Referring to FIG. 5, the projectile 46 corresponds in most respects to projectile 14 in FIG. 4 except that outer jacket layer 28 is omitted and rotating band 48 has been added in lieu thereof. Band 48 functions in the familiar manner to engage lands and grooves in a rifled gun barrel and to impart rotation to the projectile 46. The band typically is made from a metal or alloy softer than the projectile itself and is force fit, swaged or shrunk-fit onto the projectile for secure attachment thereto.

Figure 6:
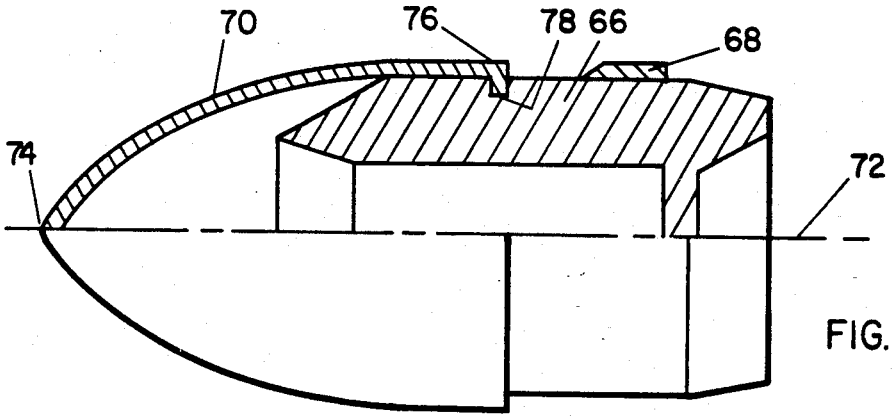
FIG. 6 is a view similar to FIG. 5 showing a modification of the FIG. 5 projectile.

FIG. 6 shows a projectile 66 corresponding closely to that seen in FIG. 5 except that a thin-walled hollow nose fairing 70 has been added to reduce aerodynamic drag. Thus, fairing 70 has a smooth bullet-nose shape tapering forwardly to a point 74 opposite from an annular radially inward-projecting flange 76 adapted to engage a circular groove 78 formed in the outer surface of the projectile and sized to receive and to grip the flange 76 in firm fixed relationship. Nose tip 74 is centered on longitudinal axis 72. In addition, the aft boattail cavity of projectile 66 which corresponds to cavity 56 in FIG. 5, may optionally be filled with a bright burning tracer composition to make the trajectory of the projectile more visible as it traverses from the gun muzzle to the target, as suggested by tracer composition 75 which may be any suitable agent known to the prior art.

Figure 7:
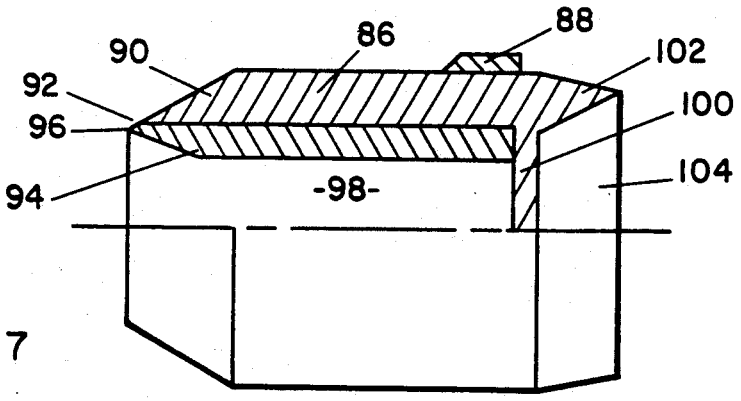
FIG. 7 is a view similar to FIG. 5 showing a modification of the FIG. 5 projectile.

FIG. 7 shows a round generally similar to that seen in FIG. 5, but with a hardened steel or exotic alloy liner or penetrator 94 of cylindrical sleeve form and concentrically held within projectile 86 in closely nested and firm fixed relationship. Sleeve 94 surrounds a cavity 98 and terminates at its forward end in a sharp annular leading edge 96 which is shaped so as to form a substantially continuous angle with the outer beveled surface 90 of projectile 86 whereby edge 92 of the projectile body blends continuously between surface 90 and edge 96. Sleeve 94 abuts wall 100 at the aft end of the sleeve whereby force which accelerates projectile 86 through the gun barrel is transferred to the sleeve by the wall. At impact, sleeve 94 will pierce through a target surface under added momentum from the speed and mass of projectile 86 acting through wall 100 and increasing the lethality and force of the sleeve beyond which it alone could achieve. This is due to the fact that, under the mass-momentum theory, the penetration effectiveness of sleeve 94 will be essentially proportionate to the weight and velocity of of the sleeve at the instant of impact. However, the added mass of the total projectile 86, when combined with the relatively lightweight sleeve 94, results in a tremendous increase of effectiveness in the penetration characteristics of the sleeve alone. This could be even further enhanced by the optional addition of more weight in aft cavity 104 such as to fully occupy the cavity.

Figure 8:
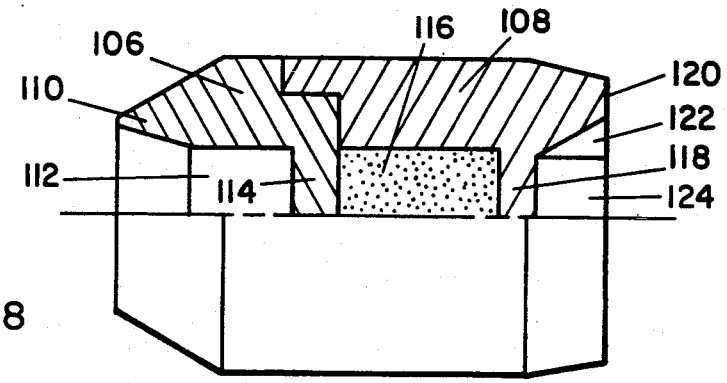
FIG. 8 is a view similar to FIGS. 5 and 7 showing another modification of the projectile.

FIG. 8 shows a composite multi-mission projectile which might advantageously be used in large caliber ammunition, but could be adapted also in small sizes as well. Thus, forward projectile portion 106 is securely affixed to aft projectile portion 108 by any suitable means such as screw threads (not shown), swaging or force-fitting as shown. Element 106 has a generally conical nose portion 110 with a hard sharp-edged annular leading edge at the foremost end thereof, concentric about center longitudinal axis 111. Portions 106 and 108, as indeed the entire projectile seen in FIG. 8, are symmetrical about axis 111. Potion 10 as a center cavity 112 terminating in a wall or partition 114 which is substantially normal, to axis 111, and formed with an outer diameter less than the outermost diameter of portion 106, resulting in a central protruding boss or annular projection 113 radially outward from wall 114 and integrally formed with forward portion 106.

Aft portion 108 has an oppositely corresponding contour in the form of a circumferential flange or forwardly projecting ridge 115 which surrounds and securely engages boss 113 in fixed relationship therewith. Aft portion 108 is also provided with a center cavity 116 which is concentric about axis 111 and which may be filled with a suitable agent adapted to fulfill the purpose of the round. For example, when armor-protected target penetration is desired to be followed by explosive fragmentation within the armor-protected area, cavity 116 may be filled with high explosive. Toward this end, cavity 116 terminates at its aft end in a wall or closure means 118 integrally formed with portion 108. Within a boattail shaped aft end 120, an aft cavity 122 is formed, thus providing space to accommodate a primer 124 of any suitable type known to the prior art and adapted to detonate explosive in cavity 116 after the projectile 106, 108 has penetrated within the target.

It will further be understood that in any of the various embodiments shown by the drawings and discussed above, various tracer or incendiary agents known to the prior art may be include in the aft cavity of any suggested projectile, such as cavity 56 in FIG. 5 or 122 in FIG. 8, as examples. Similarly, in place of bands 48 and 88 in FIGS. 5 and 7, respectively, outer jacket layer 28 in FIG. 4 may be substituted for such bands where appropriate.

It is of critical importance to the invention in this case that in all of the embodiments shown and discussed herein, the projectile has a sharp rigid forward annular leading edge and a deep cavity operatively associated therewith such that the leading edge will cut rather than deform, and that some of the target material removed by this cutting action may displace into the center hollow forward cavity of the projectile. In the absence of such displacement, target material may become wedged firmly within the noted cavity such as to fully occupy the same, resulting in an essentially solid mass which will thereafter exhibit ballistic characteristics closely similar to a conventional solid projectile. This possibility is avoided or minimized by assuring that the forward cavity is relatively deep in each of the projectiles shown, such as not less than one hole diameter in depth and preferably at least 1-½ to 2 diameters in depth.

The terminal ballistic characteristics of the inventive projectile in this case are startling and unlike those associated with prior art bullets. Thus, the projectile in this case has enhanced penetration characteristics against so-called "bullet-proof" materials, such as Kevlar TM material used in helmets and vests. Also, in body tissue or similar media, the bullet typically transfers 100 percent of its impact energy into the media rather than exiting at a substantial velocity after passing through a body such as bullets of prior art design.

I claim:

1. Ammunition for small arms weapons, comprising:

primed cartridge case means adapted to hold a projectile and to contain a propellant mixture for propelling a projectile through a gun barrel, and a single unitary elongate projectile operatively related to said case means, said projectile being symmetrical about a center longitudinal axis and having a forward end and an aft end, and a hollow nose at said forward end with a hard relatively undeformable sharp annular leading edge contiguous with a bore hole center cavity extending rearwardly from said nose to a solid closure wall proximate the aft end of said projectile, the geometrical shape of the projectile exterior being a modified cylinder wherein the projectile diameter is narrowed at the front end, and tapered to increase, straight line, over a first region of the projectile, thence increasing again, straight line, in a bevelled second contiguous region, until equalling the cylinder diameter at end of said second region, being of smaller slope than that in the said first region; the aft end of said projectile also straight line tapered so that the projectile is narrower at its end; the center cavity bore hole modified so that it is widened at the front end of said projectile and its diameter tapered to decrease straight line over a third region until it equals that of the bore's diameter; the said sharp annular leading edge being formed by intersection of the frusto-conical surfaces of the said exterior first tapered surface, with that of the inner surface at the front end of said center cavity.

2. The structure in claim 1, further including rotational force-transmitting means including a mass of relatively soft metal secured about said projectile and adapted to engage lands and grooves in said gun barrel and to input said force to said projectile.

3. The structure in claim 2 above, wherein said mass consists of an outer jacket layer over said projectile intermediate said forward and aft ends.

* * * * *